US012735793B2

(12) United States Patent
Zenou

(10) Patent No.: US 12,735,793 B2
(45) Date of Patent: Sep. 15, 2026

(54) METHODS FOR LASER INDUCED PRINTING OF ELECTRODES WITH INCREASED LIFESPAN

(71) Applicant: Reophotonics, Ltd., Modiin (IL)

(72) Inventor: Michael Zenou, Hashmonaim (IL)

(73) Assignee: Reophotonics, Ltd., Modiin (IL)

( * ) Notice: Subject to any disclaimer, the term of this patent is extended or adjusted under 35 U.S.C. 154(b) by 16 days.

(21) Appl. No.: 18/964,962

(22) Filed: Dec. 2, 2024

(65) Prior Publication Data

US 2026/0152859 A1 Jun. 4, 2026

(51) Int. Cl.
*C23C 24/10* (2006.01)

(52) U.S. Cl.
CPC ..... *C23C 24/10* (2013.01)

(58) Field of Classification Search
CPC ..... C23C 24/10
See application file for complete search history.

(56) References Cited

U.S. PATENT DOCUMENTS

2022/0040912 A1* 2/2022 Zenou ..... B29C 64/35
2024/0064897 A1 2/2024 Zenou et al.
2024/0080992 A1 3/2024 Zenou et al.

OTHER PUBLICATIONS

Invitation to Pay Additional Fees, Partial International Search and Written Opinion mailed Feb. 27, 2026, from the ISA/European Patent Office, for International Application No. PCT/IB2025/062320 (filed Dec. 2, 2025), 10 pgs.

* cited by examiner

*Primary Examiner* — Nathan T Leong
(74) *Attorney, Agent, or Firm* — Ascenda Law Group, PC

(57) ABSTRACT

Method for creating an electrode on a substrate using a laser assisted deposition process. A metal paste is printed and dried on the substrate to form a conductive layer, and by 2D or 3D inspection, the dimensions of the conductive layer are measured. The substrate is subject to a pretreatment process so as to increase adhesion and/or conduction of the conductive layer to the substrate. An electrode that is produced according to the present method may be used in flexible devices.

10 Claims, 12 Drawing Sheets

METHODS FOR LASER INDUCED PRINTING OF ELECTRODES WITH INCREASED LIFESPAN

FIELD OF THE INVENTION

The present invention relates to systems and methods for printing conductive materials on a substrate using laser induced forward transfer, and more particularly relates to a process for printing electrodes on a substrate.

BACKGROUND

Printed electrodes are emerging as ideal candidates for meeting the challenges facing the next generation of small portable electronics, wearables, and Internet-of-Things (IoT) devices, as they show potential for aesthetic versatility, flexibility, and monolithic integration. Multiple printing techniques have been developed over the years to pattern ink slurry onto various substrate materials, including organic (e.g., polymers) and inorganic (e.g., metals) materials. Using similar printing methods, electroactive and conductive materials can be layered onto flexible substrates to produce patterned flexible electrodes. The production throughput of flexible electrodes can be increased if all the components can be printed on the same assembly line by roll-to-roll (R2R) technology or other means. Consequently, printed electrodes are often associated with cost-effective manufacturing with better energy densities at sub-millimeter thicknesses that are superior to those of competing technologies. Discussed herein are techniques for printing electrodes using laser induced forward transfer (LIFT) with certain advantages over the R2R technology.

SUMMARY OF THE INVENTION

Advantages of using laser induced material transfer for printing electrode connectors include an increased lifespan of the electrodes with robust electrical performance. In one embodiment, a method of the present invention additionally provides an improved adhesion and conduction between a conductive layer of an electrode and an underlying substrate layer.

In one embodiment, the substrate can be a flexible substrate or a rigid substrate.

In one embodiment, the electrode production may involve several steps of printing and use several different materials for the production.

In one embodiment, the electrode material may be printed in the form of a slurry.

In one embodiment, the electrode material may be carbon nanotube (CNT) material, the CNTs including single-wall or multiwall CNTs.

In one embodiment, a metal paste may be printed at a desired location on a substrate.

In one embodiment, the printing process may be performed using laser assisted deposition (LAD) to transfer the metal paste from a coated film onto the substrate.

In one embodiment, the paste that is used for the process may be a conductive carbon paste.

In one embodiment, the surface structure of one electrode may be produced by the laser induced transfer process. The produced conductive lines are very uniform (e.g., in terms of thickness and width), stable over time, and have excellent adhesion to the substrate.

Current printing techniques can have over 100 square microns of regions with defects, creating a very large area that cannot be used for electronics because of the defective traces that can be found in that large area. However, in one embodiment of the present invention, laser induced transfer can be used to print multiple layers of an electrode with increased uniformity of the electrode (statistically) and a reduction of the defective area to below 20 square microns, enabling denser patterns and enhanced electrical conductivity.

In one embodiment, the excellent adhesion of the conductive material to the substrate is of great importance. Since the substrate can be flexible, any movement can create a break in the conductive layer, and poor adhesion will also decrease the conduction and the charging ability.

In one embodiment, the process may begin by pretreating a conductive substrate (e.g., a metal or other material) with a laser.

In one embodiment, the pretreatment may be performed directly by the laser on the substrate or by jetting metal onto the substrate from a foil coated with a metal, the former and latter both improving the adhesion between the conductive layer and the substrate.

In one embodiment, after the pretreatment of the substrate, a material layer may be printed on the substrate, followed by using hot air or heating elements to dry the material layer to form a conductive layer on the surface of the substrate.

In one embodiment, the print and drying process can be repeated several times to increase the uniformity of the conductive layer.

In one embodiment, the pastes that are used in the process are all in the form of a liquid and typically contain metal particles suspended or dissolved in a solvent with additives. The metal particles may be sintered to one another to form the conductive layer and the solvent may be evaporated to enable the sintering process. Therefore, after printing the paste on the substrate, the solvent in the metal paste may be evaporated to form a solid structure. Typically, the solvent may be evaporated by heating the metal paste to 100-200° C.

In one embodiment, the drying can be performed by flowing hot air over a surface of the substrate for several seconds, by heating the surface of the substrate using an infrared (IR) lamp, and/or by any other known drying process. Typically, the drying takes 30-200 seconds.

In one embodiment, the drying is performed in an inert environment.

In one embodiment, the inert environment comprises inert gas.

In one embodiment, after the drying step, the particles that remain may be in a solid form and a control of height and positioning of a conductive layer with the particles can increase the accuracy of the process. Using a camera, a 2D microscope or a 3D microscope, the height and dimensions of the conductive layer can be measured and then fixed (e.g., remediated), if needed. Example remediation steps include printing additional material if the height of the conductive layer is less than a desired height and/or performing laser ablation if the height of the conductive layer is more than a desired height.

In one embodiment, the pretreatment of the substrate may play an important role for the adhesion of the conductive patterns to the substrate, particularly in the case where the substrate is an aluminum substrate. The reason is that an aluminum substrate tends to oxidize and the oxide layer may inhibit the conduction and the adhesion between the conductive pattern and the substrate.

In one embodiment, the pretreatment may be performed by using a laser to roughen the surface of the substrate so as to improve the adhesion between the conductive pattern and the substrate, while in other embodiments, the pretreatment may be performed by jetting metal from a metal-coated thin film onto the substrate. The laser may be absorbed by the thin metal layer that is attached to the film, and the thin metal layer may be heated by the laser and evaporated (or blasted into small particles) toward the substrate, creating a large collection of metal particles over the surface of the substrate. At the same time, the substrate may also be heated and patterned by the laser, and therefore a layer of the two metals (i.e., a multi-material layer) may be produced on the surface of the substrate.

In one embodiment, the multi-material layer may play an important role in enhancing the adhesion between the substrate and the electrode, and the properties of the metal layer on the metal-coated thin film may govern the properties of the multi-material layer.

In one embodiment, the thin film may be coated by a very thin film of titanium 5-50 microns thick, and the metal substrate may be aluminum. The mixture of aluminum and titanium may create a rough layer on the surface of the substrate with excellent conduction properties.

Moreover, the rough layer may improve both the adhesion and the conduction between the substrate and electrode, which in turn enhances the stability and robustness of the structure, ultimately leading to a better charging property of the electrode.

In one embodiment, a cathode of an electrical device is formed by a pretreatment of the substrate and the printing of several layers, each with different material properties, on the substrate.

In one embodiment, the thin film may be coated by a thin film of titanium 5-50 microns thick, and the metal substrate may be aluminum. The mixture of aluminum and titanium may create an intermediate layer with excellent conduction properties that enhances the conduction between the multiple layers of the electrode and redistributes the charge horizontally (e.g., in a direction parallel to an interface between the metal substrate and the electrode) to all portions the conductive layer (because the intermediate layer is conductive) and therefore enhances the charge flow in the next layer of the electrode, which in turn enhances the stability and robustness of the electrode, ultimately leading to a better charging property of the electrode.

In one embodiment, an electrode that is produced according to the present method may be used as part of the formation of flexible devices, significantly increasing the electrode reliability and charging retention properties of a battery or capacitor.

These and further embodiments of the invention are described in greater detail below.

BRIEF DESCRIPTION OF THE DRAWINGS

The present invention is illustrated by way of example, and not limitation, in the figures of the accompanying drawings, in which.

DESCRIPTION OF THE INVENTION

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention. Descriptions associated with any one of the figures may be applied to different figures containing like or similar components.

The present invention aims to simplify the steps to achieve a desired doping of the electrode. Furthermore, a strong adhesion of the printed electrode to the substrate is important for two main reasons: First, since the substrate can be flexible, any movement can create a break in the conductive lines or patterns. Second, a poor adhesion may decrease the conduction and the charging ability. The high uniformity of the laser induced transfer process reduces the likelihood of breaks forming in the electrode and therefore increases its reliability. However, the use of laser induced transfer has a much greater and important effect on the adhesion and the conduction in the interface between the electrode and the substrate, as it has the ability to dope the substrate or the conductive layer with a desired metal.

Figure 1A:
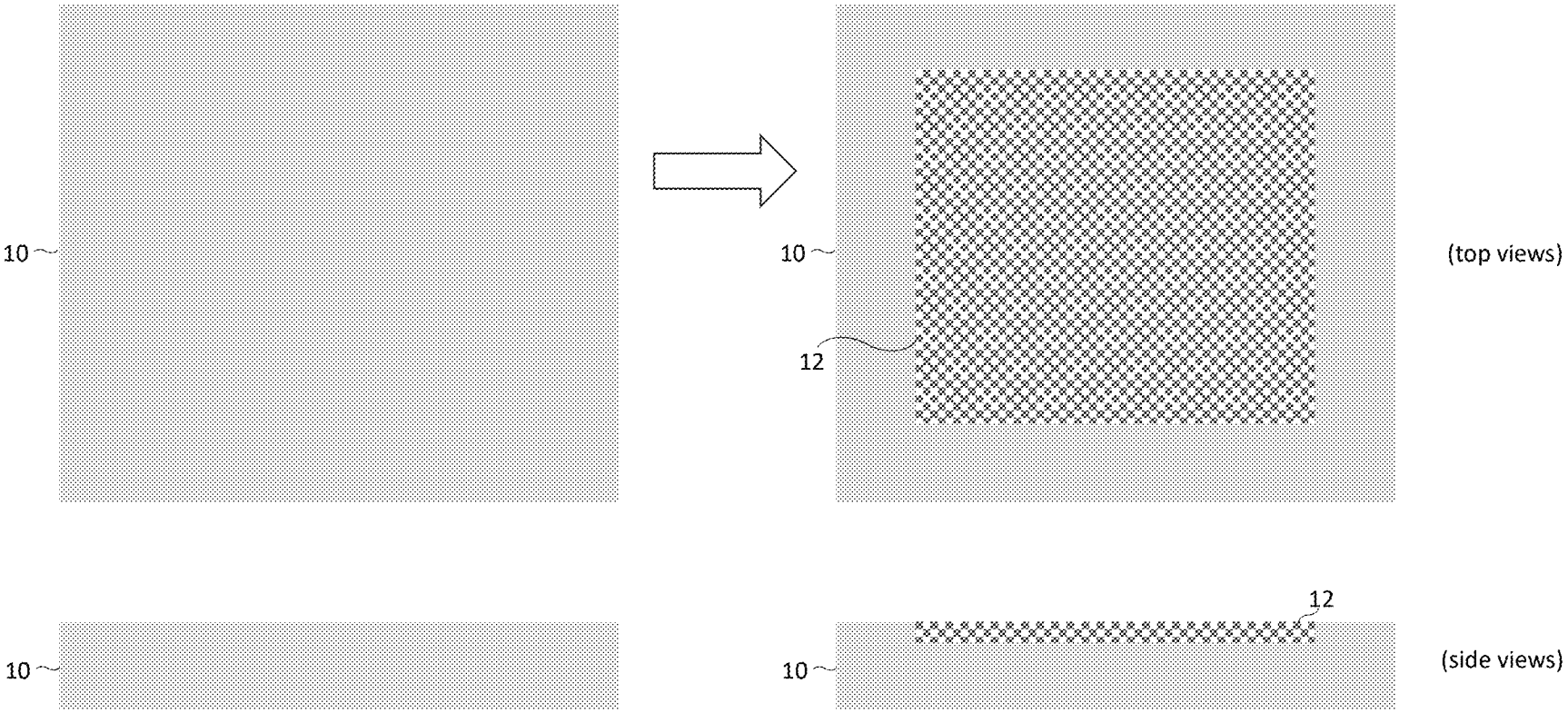
FIGS. 1A-1D illustrate a process for producing an electrode, which includes pretreatment of the substrate (FIG. 1A), printing electrode material (FIG. 1B), drying the electrode material (FIG. 1C), and repeating the printing and drying steps as necessary to produce the final electrode (FIG. 1D), in accordance with one embodiment of the invention.
Figure 1B:
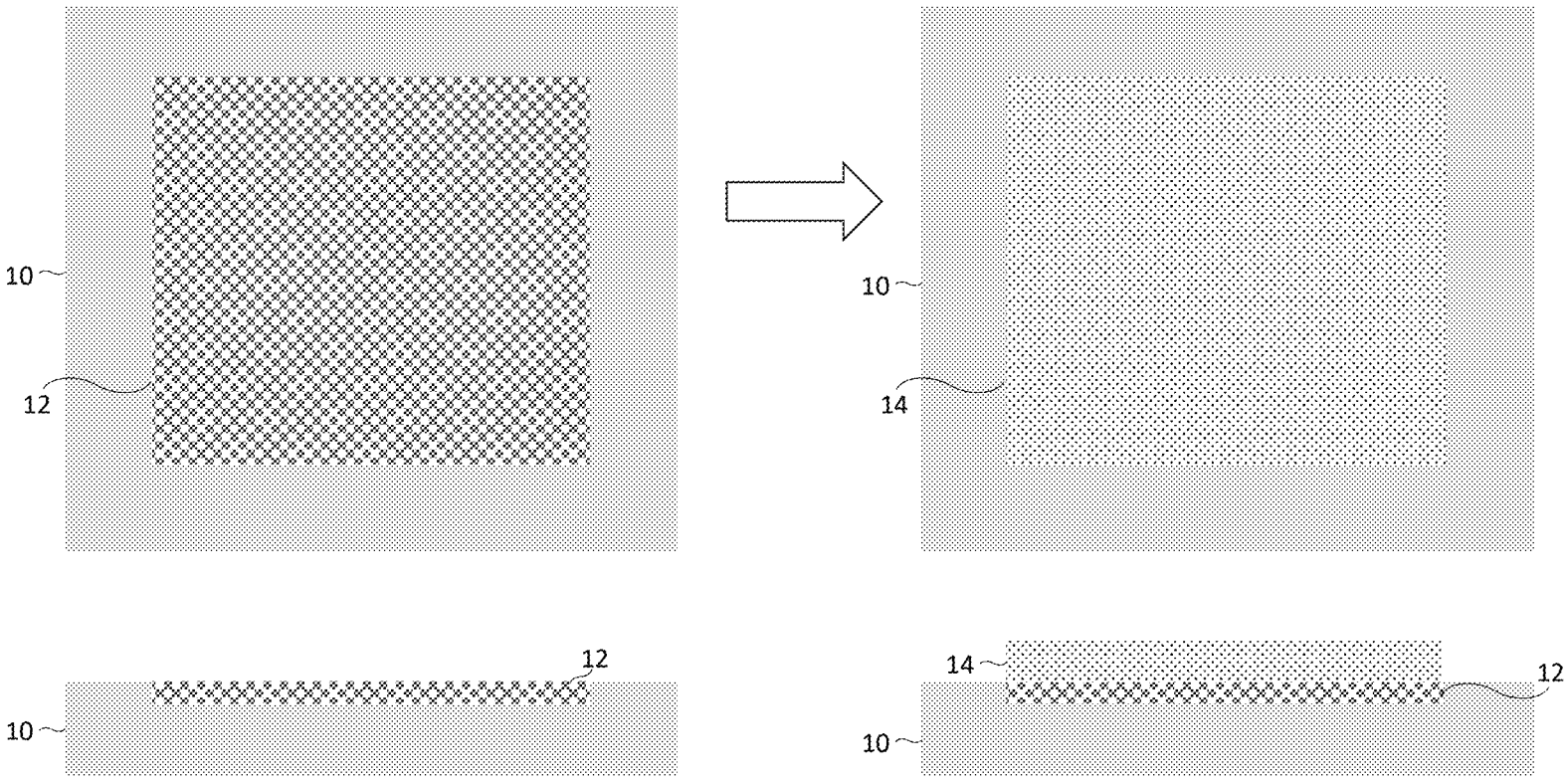
Figure 1C:
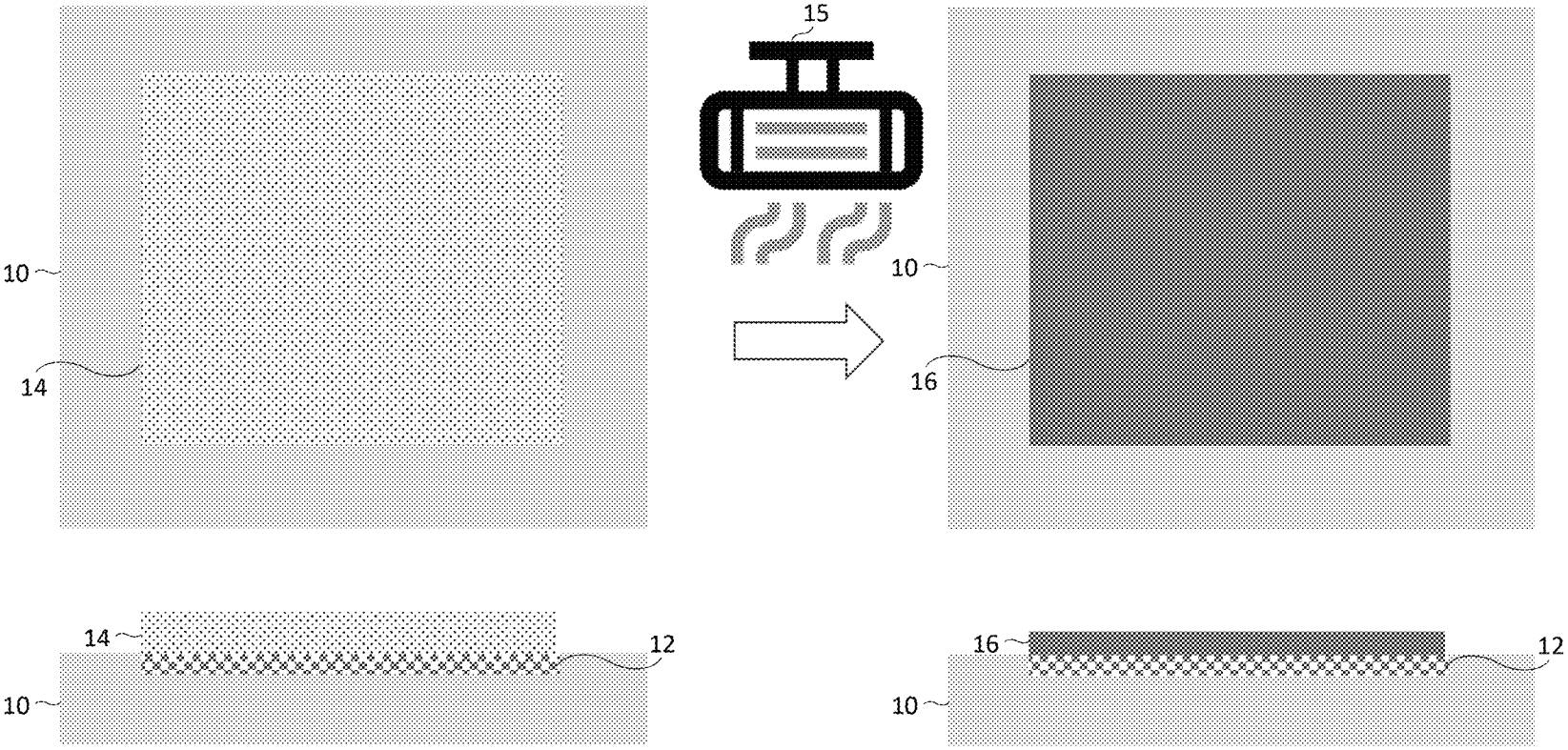
Figure 1D:
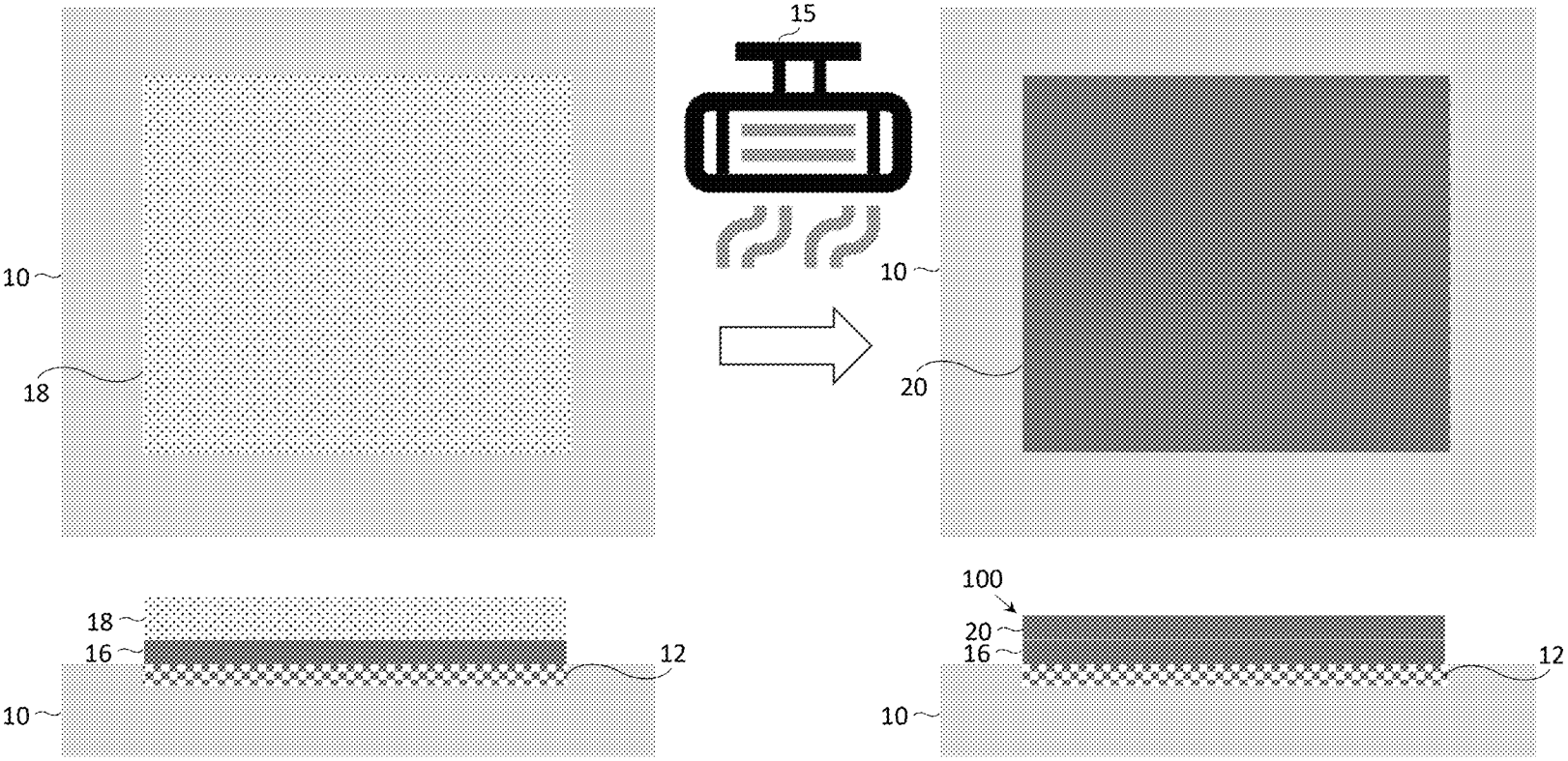
Figure 2:
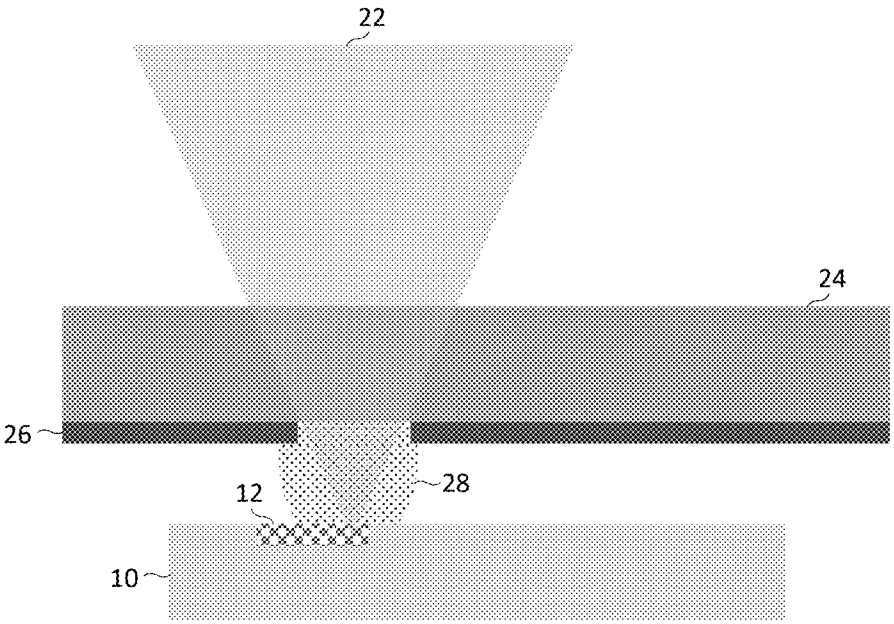
FIG. 2 illustrates the pretreatment process which may include the use of a laser to alter the properties of the substrate interface, in accordance with one embodiment of the invention.

FIGS. 1A-1D illustrate a process for producing an electrode 100. As depicted in FIG. 1A, the process may start by pretreating a portion of a conductive substrate 10 (e.g., metal or other material) using a laser 22 (as depicted in FIG. 2), thereby forming a pretreated portion 12 of the substrate 10. The pretreatment can be performed by directly exposing the substrate 10 to laser 22 or by jetting metal particles from a foil 24 coated with a metal layer 26 (as depicted in FIG. 2) onto the substrate 10, which particles can be used as a dopant and/or to increase the adhesion between the substrate 10 and the electrode 100. After the pretreatment, the material layer 14 (also called a paste layer) may be printed on the pretreated portion 12 of the substrate 10, as depicted in FIG. 1B. The printed layer 14 may be dried and sintered by hot air or heating element 15, as depicted in FIG. 1C, forming a conductive layer 16 (e.g., a conductive trace, a conductive pattern, a conductive line) on the pretreated portion 12. An additional layer 18 may be printed on the conductive layer 16 (as depicted on the left side of FIG. 1D), and then dried and sintered so as to form a second conductive layer 20 (as depicted on the right side of FIG. 1D). In practice, conductive layer 16 and conductive layer 20 may form a single conductive layer; however, for ease of depiction, conductive layers 16 and 20 are shown as two separate layers in FIG. 1D. The printing and drying processes can be repeated several times to increase the uniformity and/or thickness of the conductive layer.

The pastes that are used in the process may be in the form of a liquid and typically contain particles suspended or dissolved in a solvent with additives. Therefore, in one embodiment, the solvent may be first evaporated from each of the printed layers 14, 18 to form a solid structure, before the particles are sintered to one another so as to form a conductive layer. Typically, the solvent may be removed by heating each of the printed layers 14, 18 to 100-200° C. The drying can be performed by hot air that flows onto the substrate 10 for several seconds or by an infrared (IR) lamp (not depicted) that heats the surface of the substrate 10, or by any other known drying process. Typically, the drying takes 30-200 seconds.

After drying and sintering, the particles may be in a solid form and the height and position of each of the conductive layers 16, 20 can be adjusted to a desired accuracy of the process. Using a camera, a 2D microscope or a 3D microscope, the height and dimensions of each of the conductive layers 16, 20 can be measured and fixed (i.e., remediated) if needed. Example remediation steps include printing additional material if the height of the conductive layer is less than expected and/or performing laser ablation if the height of the conductive layer is more than expected.

The pretreatment of the substrate 10 may play an important role in the adhesion of the conductive patterns to the substrate 10, particularly in the case where the substrate 10 is an aluminum substrate. The reason is that an aluminum substrate tends to oxidize and the oxide layer may inhibit both the conduction and adhesion between the conductive layer 16 and the substrate 10. Through the pretreatment step, the laser 22 can roughen the surface of the substrate 10, which strengthens the adhesion between the substrate 10 and the conductive layer 16, but the major effect of the laser induced pretreatment is illustrated in FIG. 2.

FIG. 2 illustrates the pretreatment involving a metal coated thin film 12 on a substrate 10. The laser 22 may be absorbed by the thin metal layer 26 that is attached to the film 24, and the thin metal layer 26 may be heated by the laser 22 and evaporated (or blasted into small particles 28) toward the substrate 10, creating a large collection of metal particles over the surface of the substrate 10. At the same time, the substrate 10 may also be heated and patterned by the laser 22 and therefore a layer 12 of the two metals may be produced on the surface of the substrate 10.

The multi-material layer 12 may play an important role in enhancing the adhesion between the substrate 10 and the electrode 100 formed on the surface of the substrate 10, and the properties of the thin metal layer 26 may govern the properties of the multi-material layer 12. In the case where the thin film 24 is coated by a thin film 26 of titanium 5-50 microns wide (or thick, depending on the orientation of the thin film 26), and the metal substrate 10 is aluminum, the mixing of aluminum and titanium may create a rough layer with excellent conduction properties. The rough layer may improve both the adhesion and the conduction between the substrate 10 and the patterned conductive lines formed over the top surface of the substrate 10, which in turn enhances the stability and robustness of the structure, ultimately leading to a better charging property of the electrode 100.

Figure 3A:
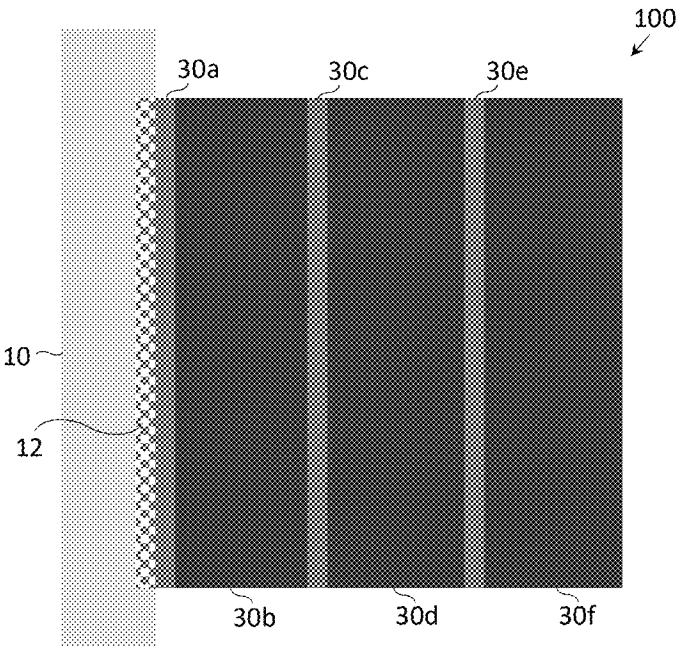
FIG. 3A illustrates an alternative process for producing an electrode with the ability to control the height of various layers of the electrode, in accordance with one embodiment of the invention.

FIG. 3A illustrates schematically an alternative process to produce an electrode 100 by pretreatment of the substrate 10 and printing six different layers 30*a*-30*f*, each with different properties. The typical width of each of layers 30*a*, 30*c* and 30*e* is 2-3 microns (layers 30*a*, 30*c* and 30*e* being doped by the metal on the film), while the typical width of layers 30*b*, 30*d* and 30*f* is 35-45 microns (layers 30*b*, 30*d* and 30*f* containing the active material). Again, the width may instead refer to a thickness of the layer, depending on the orientation of the structure. Layers 30*a*, 30*c* and 30*e* may each be called a conduction enhancement layer, while layers 30*b*, 30*d* and 30*f* may each be called an active material layer.

Figure 3B:
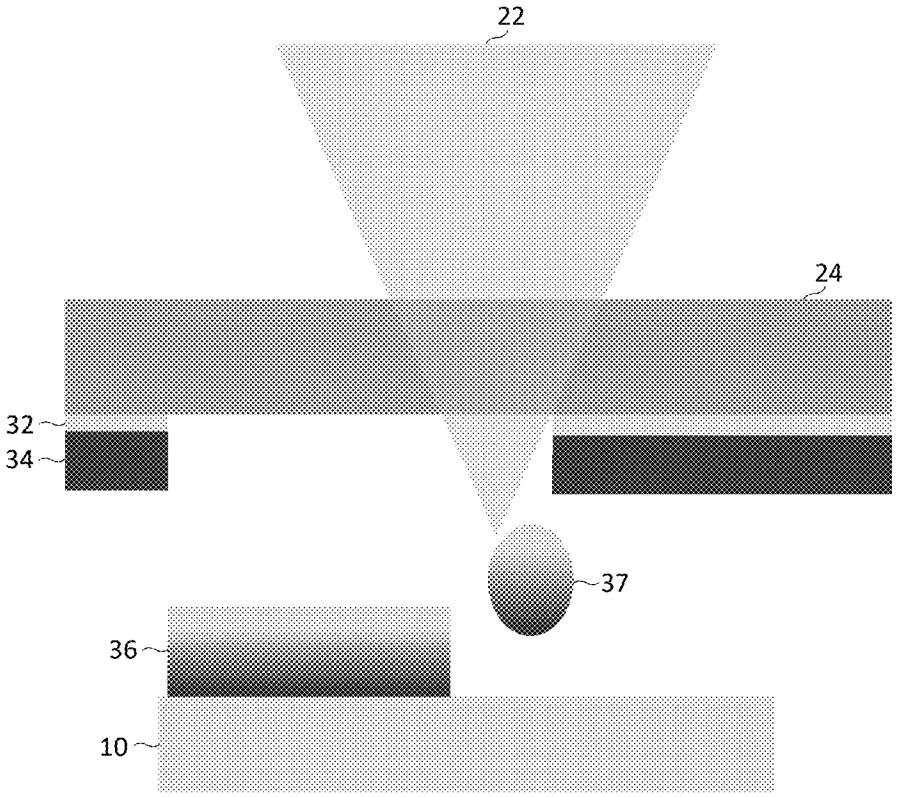
FIG. 3B illustrates the fabrication of the conduction enhancement layer, in accordance with one embodiment of the invention.
Figure 3D:
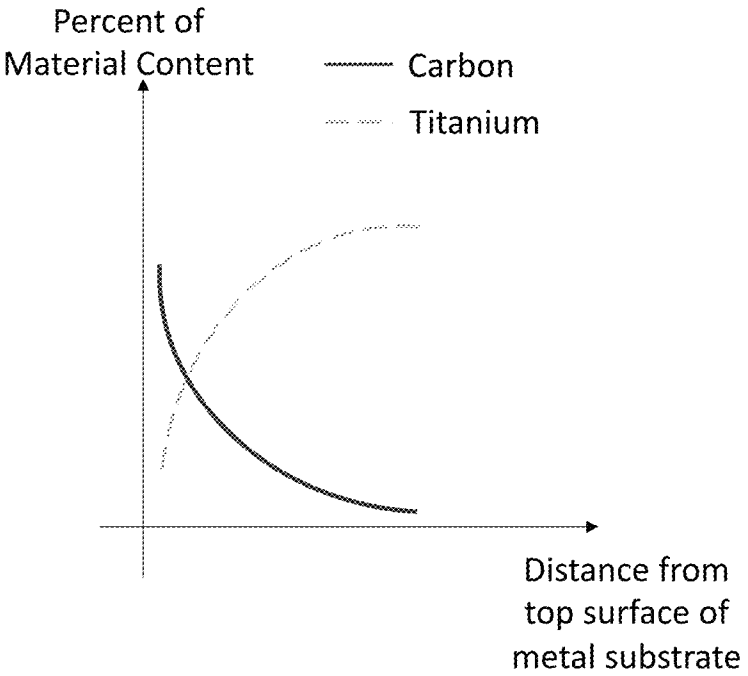
FIG. 3D illustrates the material composition of the conduction enhancement layer, in accordance with one embodiment of the invention.
Figure 3C:
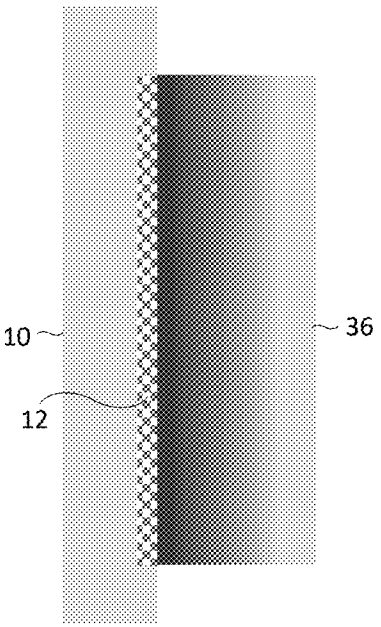
FIG. 3C illustrates the structure of the conduction enhancement layer, in accordance with one embodiment of the invention.

FIG. 3B illustrates how each of the conduction enhancement layers 30*a*, 30*c* and 30*e* are produced. The laser 22 may be absorbed by (i) the dopant layer 32 (e.g., titanium layer) that is attached to the film 24 and (ii) the carbon layer 34 that is attached to the dopant layer 32. The heating from the laser 22 may cause the dopant layer 32 and carbon layer 34 to be evaporated (or blasted into small particles 37) toward the substrate 10, creating a thin layer 36 of carbon on the surface of the substrate 10 that is doped with the dopant (e.g., titanium). As shown in FIGS. 3C and 3D, the thin layer 36 may have a gradient of titanium particles and therefore the conduction of the thin layer 36 may be higher than that of an undoped carbon layer. More specifically, as shown in FIG. 3D, the concentration (or percentage) of titanium may increase in the thin layer 36 as the distance from the top surface of the metal substrate 10 increases, and the concentration (or percentage) of carbon may increase in the thin layer 36 as the distance from the top surface of the metal substrate 10 decreases. If not already apparent, it is noted that the dimensions of the layers have not been drawn to scale, and the width of the thin layer 36 has been exaggerated to better show the gradient of materials therein.

Figure 4A:
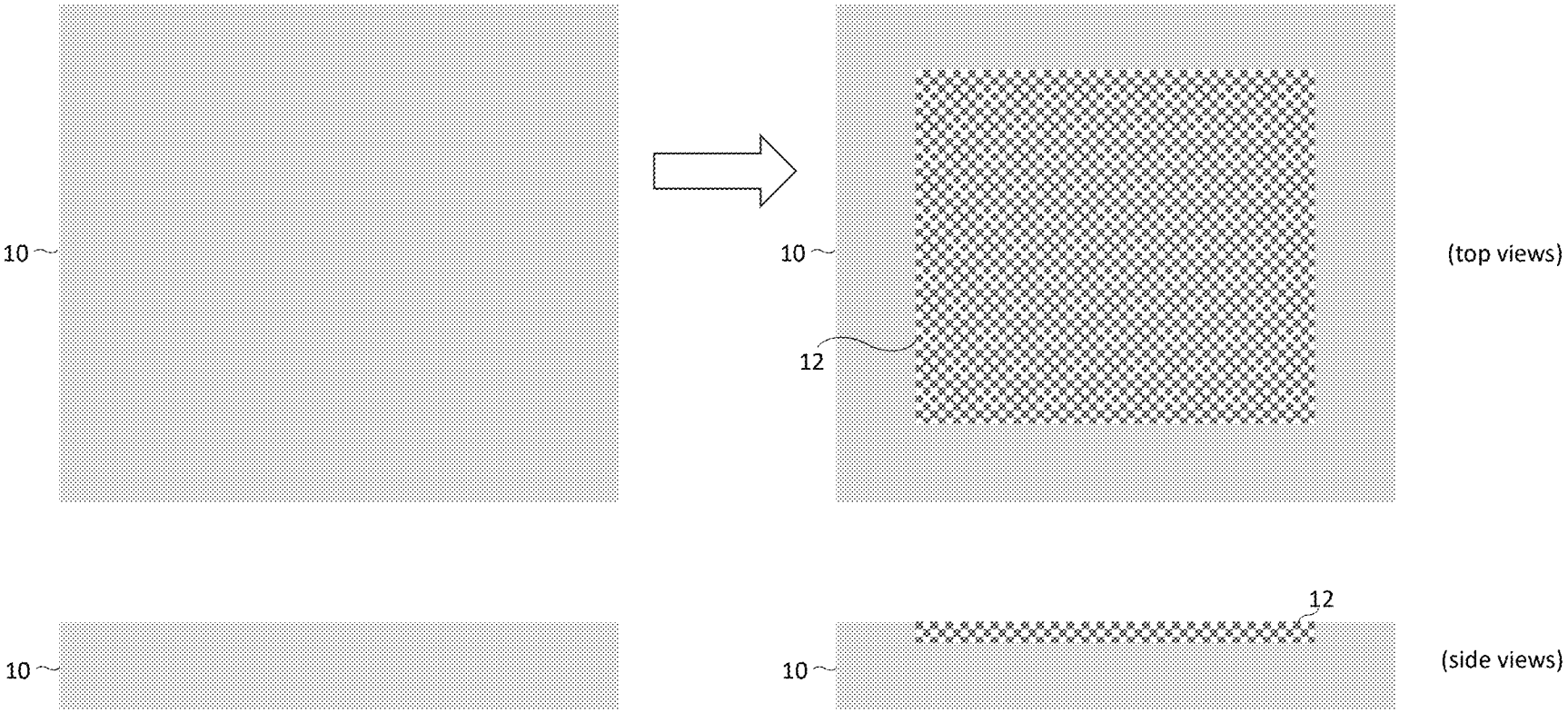
FIGS. 4A-4D illustrate an electrode production process, including pretreatment of the substrate (FIG. 4A), printing a highly doped layer to enhance conduction utilizing the laser material transfer process (FIG. 4B), drying the highly doped layer (FIG. 4C), and then printing and drying a material layer over the highly doped layer (FIG. 4D), in accordance with one embodiment of the invention. Repeating the steps depicted in FIGS. 4B-4D may produce a final structure comprising several layers with metal doping therebetween.

FIGS. 4A-4D illustrate a process for producing an electrode 100 with the addition of dopant layers in between the material layers. As depicted in FIG. 4A, the process may start by pretreating a portion of a conductive substrate 10 (e.g., metal or other material) with a laser 22, as depicted in FIG. 2, thereby forming a pretreated portion 12 of the substrate 10. The pretreatment can be performed by directly exposing the substrate 10 to laser 22 or by jetting metal particles from a foil 24 coated with a metal layer 26 (depicted in FIG. 2) onto the substrate 10, which particles can be used as a dopant and/or to increase the adhesion between the substrate 10 and the electrode 100.

Figure 4B:
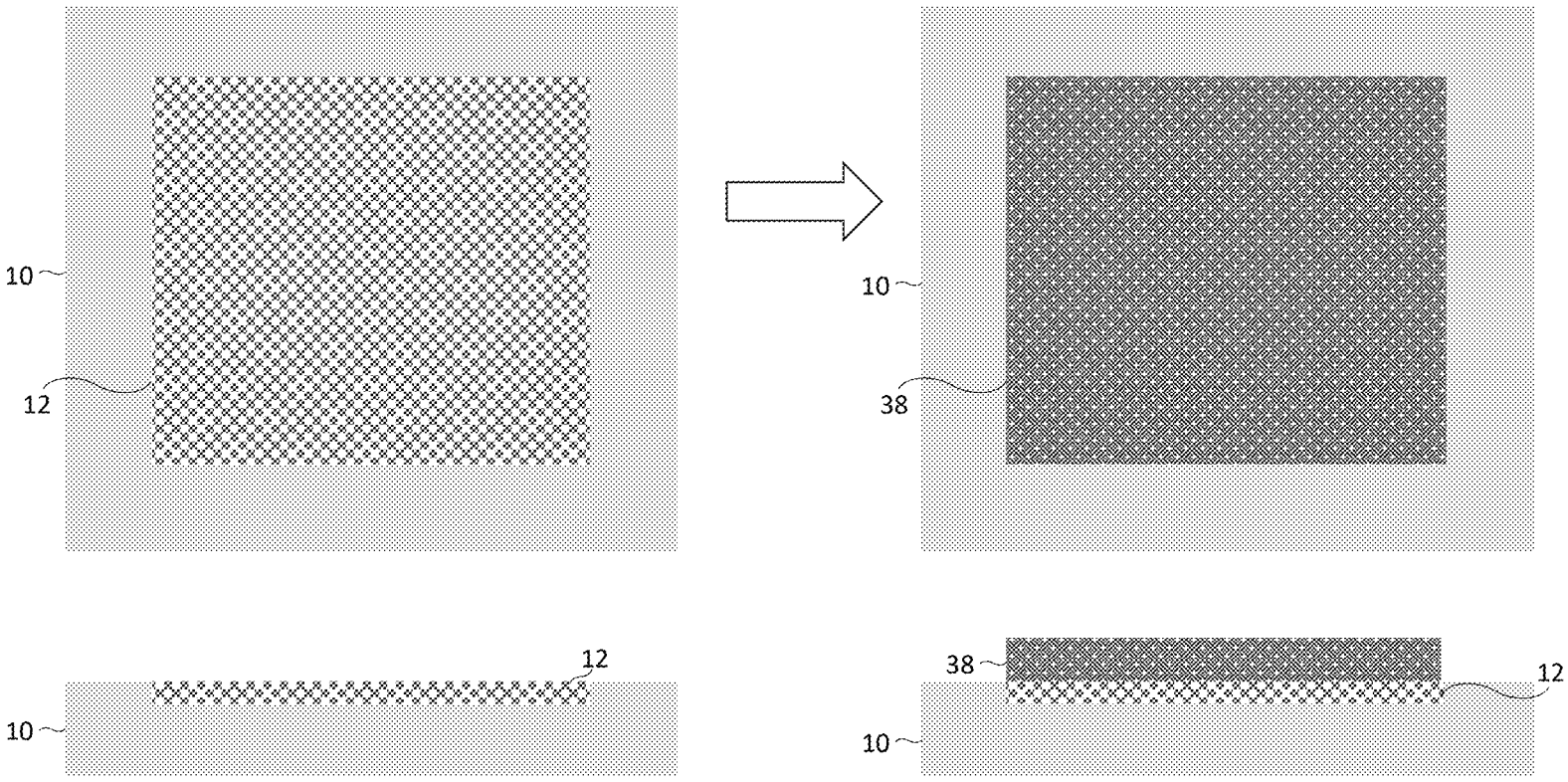
Figure 4C:
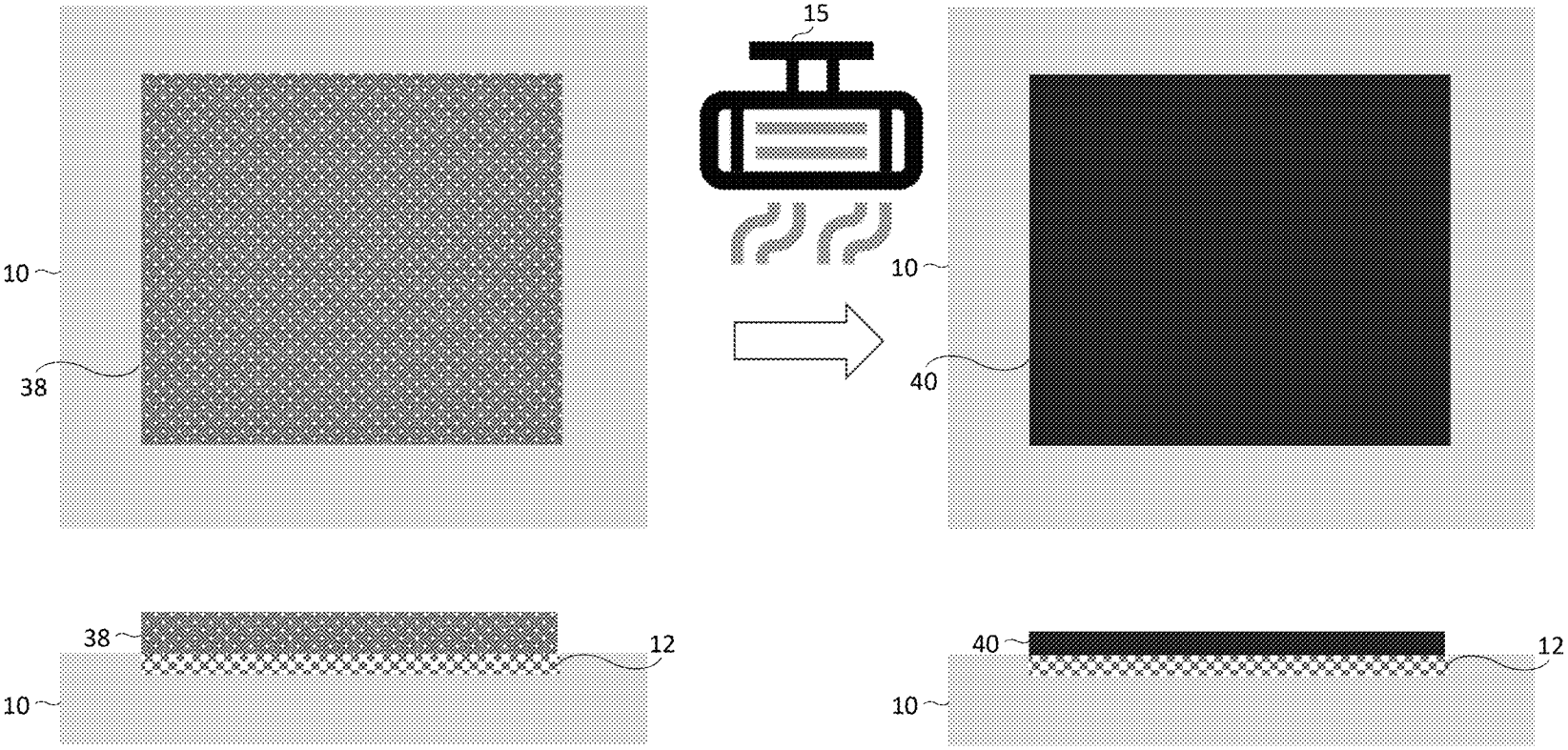
Figure 4D:
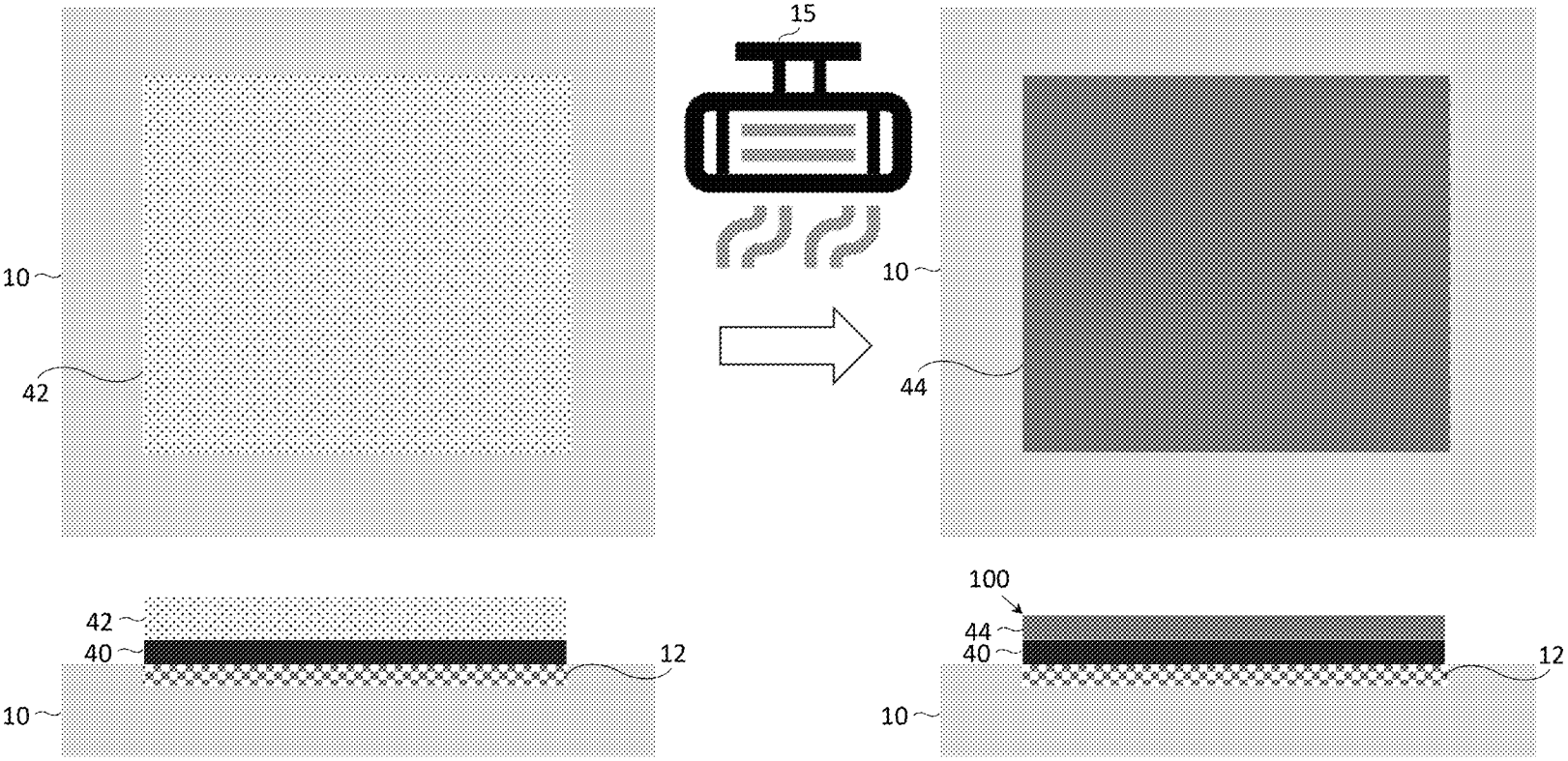

After the pretreatment, a highly doped layer 38 (typically a carbon layer doped with a dopant) may be printed on the pretreated portion 12 of the substrate 10, as depicted in FIG. 4B. In one embodiment, the concentration of dopant may be adjusted by controlling a thickness of the dopant layer 32 that coats the film 24 used during the LIFT process. The thickness of the film 24 can be 5-50 microns and the dopant layer is typically 2-3 microns. Therefore, a significant amount of dopant (e.g., metal dopant) may be incorporated within the highly doped layer 38, increasing its conductivity and its adhesion to the pretreated portion 12 of the substrate 10. The highly doped layer 38 may be dried and sintered by hot air and/or heating element 15, as depicted in FIG. 4C to create the conduction and adhesion enhancement layer 40 on the pretreated portion 12.

A material layer 42 may be printed on the adhesion enhancement layer 40 (as depicted on the left side of FIG. 4D), and then dried and sintered so as to form an active layer 44 (as depicted on the right side of FIG. 4D) of the electrode. Due to the pretreatment step and formation of the conduction and adhesion enhancement layer 40, the conduction and adhesion of the active layer 44 is greatly improved and the overall performance of the electrode is better. While not depicted, it is understood that additional alternating layers of enhancement layers 40 and active layers 44 may be fabricated so as to generate the electrode 100 previously depicted in FIG. 3A.

In one embodiment, the structure of the electrode 100 is constructed from alternating material layers and conduction promotion layers. As the thickness of the material layer increases, the respective lengths of the conduction paths through the material layer may be increased due to defects within the printed material which impede the flow of charged particles (e.g., electrons). To address this challenge, one or more conduction promotion layers can be added to the material layer in order to distribute the charges horizontally (e.g., in a direction parallel to an interface between the substrate 10 and the electrode 100) and create new paths of conduction vertically (e.g., in a direction perpendicular to the interface between the substrate 10 and the electrode 100) through the electrode 100. As such, the printing of thin and highly doped layers can enhance the overall performance of the electrode.

Thus, methods for laser induced printing of electrodes with increased lifespan has have been described. Many other embodiments will be apparent to those of skill in the art upon reviewing the above description. The scope of the invention should, therefore, be determined with reference to the appended claims, along with the full scope of equivalents to which such claims are entitled.

LIST OF REFERENCE NUMERALS

10 Substrate
12 Pretreated portion of substrate
14 Printed layer, paste layer
15 Heating element
16 Conductive layer
18 Printed layer, paste layer
20 Conductive layer
22 Laser
24 Film
26 Metal layer
28 Metal particles
30*a* Conduction enhancement layer
30*b* Active material layer
30*c* Conduction enhancement layer
30*d* Active material layer
30*e* Conduction enhancement layer
30*f* Active material layer
32 Dopant layer
34 Carbon layer
36 Thin layer
37 Doped particles
38 Highly doped layer, doped paste layer
40 Conduction and adhesion enhancement layer
42 Material layer, material paste layer
44 Active layer
100 Electrode

What is claimed is:

1. A method of fabricating an electrode, comprising:
pretreating a substrate, wherein the pretreating comprises jetting metal, from a foil that has been coated with a metal layer, onto the substrate, and wherein the metal layer and the substrate are formed from different materials;
depositing a paste layer onto the substrate by laser assisted deposition;
drying the paste layer so as to form a conductive layer on the substrate; and
repeating the depositing and drying steps so as to increase a height of the conductive layer.

2. The method of claim 1, wherein the substrate is a flexible substrate or a rigid substrate.

3. The method of claim 1, wherein the paste layer is dried using hot air or an infrared (IR) lamp.

4. The method of claim 1, further comprising inspecting the conductive layer using an inspection unit, wherein the inspection unit is one or more of a camera, a two-dimensional (2D) microscope, or a three-dimensional (3D) microscope.

5. The method of claim 1, wherein the drying step is performed in an inert environment.

6. The method of claim 5, wherein the inert environment comprises inert gas.

7. The method of claim 1, wherein the pretreating further comprises roughening a surface of the substrate using a laser.

8. A method of fabricating an electrode, comprising:
pretreating a substrate, wherein the pretreating comprises jetting metal, from a foil that has been coated with a metal layer, onto the substrate;
depositing a paste layer onto the substrate by laser assisted deposition;
drying the paste layer so as to form a conductive layer on the substrate; and
repeating the depositing and drying steps so as to increase a height of the conductive layer,
wherein the metal layer is formed from titanium and the substrate is formed from aluminum, and the titanium enhances a conduction of an interface between the conductive layer and the substrate.

9. A method of fabricating an electrode, comprising:
pretreating a substrate;
depositing a paste layer onto the substrate by laser assisted deposition;
drying the paste layer so as to form a conductive layer on the substrate; and
repeating the depositing and drying steps so as to increase a height of the conductive layer,
wherein the pretreating comprises using a laser to dope a surface of the substrate with a metal so as to improve an adhesion of the conductive layer to the substrate and/or to improve a conduction between the conductive layer and the substrate.

10. The method of claim 1, further comprising forming a conduction and adhesion enhancement layer between successive active layers of the electrode, the conduction and adhesion enhancement layer promoting adhesion and conduction between the successive active layers.

* * * * *